US011478048B2

(12) United States Patent
Schulten-Gaywood

(10) Patent No.: US 11,478,048 B2
(45) Date of Patent: Oct. 25, 2022

(54) EQUESTRIAN HALF SPUR FOR USE WITH AN ADJUSTABLE SPUR HOLDER

(71) Applicant: Nicola Veronica Schulten-Gaywood, Rockford, MI (US)

(72) Inventor: Nicola Veronica Schulten-Gaywood, Rockford, MI (US)

( * ) Notice: Subject to any disclaimer, the term of this patent is extended or adjusted under 35 U.S.C. 154(b) by 71 days.

(21) Appl. No.: 17/094,756

(22) Filed: Nov. 10, 2020

(65) Prior Publication Data

US 2021/0059359 A1 Mar. 4, 2021

Related U.S. Application Data

(63) Continuation-in-part of application No. 15/819,739, filed on Nov. 21, 2017, now Pat. No. 10,827,805.

(51) Int. Cl.
*A43C 17/02* (2006.01)
*A43B 5/00* (2022.01)

(52) U.S. Cl.
CPC ..... *A43C 17/02* (2013.01); *A43B 5/006* (2013.01)

(58) Field of Classification Search
CPC ..... A43C 17/00–04; A43B 5/006
USPC ..... 54/83.1; 168/21
See application file for complete search history.

(56) References Cited

U.S. PATENT DOCUMENTS 12,338 A * 1/1855 Eubank ..... A43C 17/00 54/83.2
384,774 A * 6/1888 MoManus ..... A43C 17/00 54/83.2

* cited by examiner

*Primary Examiner* — Monica L Barlow
*Assistant Examiner* — Madeline L Douglas
(74) *Attorney, Agent, or Firm* — Frank M. Scutch, III

(57) ABSTRACT

A half-spur for use with an equestrian footwear includes a spur having a neck portion that extends in a downwardly direction when warn by the user with a tip portion, which can vary in shape and size. A curved body supports the spur where such that spur is attached to one end of the curved body. The opposite end of the curved body includes a flat, rounded edge. The curved body extends around only on one side of the rider's footwear and the rounded end is inserted into a pocket within the footwear for holding it firmly in place and pivot as needed for chosen spur tip position. The spur neck is secured at the back of the footwear in an open aperture with the tip protruding outwards and backward facing.

20 Claims, 5 Drawing Sheets

EQUESTRIAN HALF SPUR FOR USE WITH AN ADJUSTABLE SPUR HOLDER

CROSS-REFERENCE TO RELATED APPLICATION

This application is related to U.S. application Ser. No. 17/094,748 entitled EQUESTRIAN FOOTWEAR WITH INTEGRATED ADJUSTABLE SPUR SYSTEM owned by Nicola Veronica Schulten-Gaywood which was filed on Nov. 10, 2020, concurrently herewith and is incorporated by reference in its entirety.

FIELD OF THE INVENTION

The present invention relates generally to equestrian spurs and more particularly to a half-spur for use with a spur holder used with equestrian footwear.

BACKGROUND

A spur is a device that is worn on the back of a rider's boot, on or just above the heel and assists the rider in directing a horse's movement. Some specialized spurs are permanently fixed to the boot and others are temporarily secured with a strap.

The main part of a conventional spur is a rigid U-shaped bracket, called a yoke, which wraps around the back-heel area of a riding boot. A rigid protrusion, called a spur neck, is fixed to and extends backward from the center of the rear, curved portion of the yoke. The distal end of the spur neck is called a spur tip, which is the part of the spur that physically contacts the horse. Most spurs are held in place by an instep strap, which is connected to both forward, free ends of the yoke and wraps over the instep and under the sole of a boot. The instep strap holds the front part of the spur yoke in place and fastens with a buckle on the instep. The rear part of the spur yoke is held in place and supported by a spur rest, which is a small lateral protuberance that extends backward from just above the heel of a riding boot. The function of the spur rest is particularly important, as it is intended to maintain the spur neck and spur tip in a specific position relative to the horse's anatomy. However, a common problem with this traditional method of spur attachment is the likelihood of the strap loosening during equestrian activity, which causes the rear portion of the yoke to slip down over the spur rest and drop downward, which is known as a "dropped spur".

When a spur neck shifts downward (or upward) from its correct position, the point of contact between the spur tip and the horse changes—or is eliminated altogether. This diminishes the rider's control of the animal, creating a potentially dangerous situation. Because precise placement of the spur tip against the horse's side is critical, the rider must then halt the horse, dismount and re-adjust the spur and re-tighten the strap, which is inconvenient and time-consuming. Furthermore, because the strap must be very tight to prevent the spur from shifting, the rider experiences severe discomfort on the instep of her/his foot.

Another disadvantage when utilizing a spur rest is that only one spur position is available, forcing the rider to spend quite a bit of time adjusting the length of the spur straps to an exact needed length. This being an undesirable situation, it would be advantageous to have a connective arrangement wherein the spur could be secured to a rider's foot more conveniently, and in a way that would prevent the spur from shifting, and causing discomfort over the instep area of the foot. Also, because short and tall riders have different leg lengths, it would be beneficial if the spur neck could be easily lifted or lowered, so as to optimize vertical placement of the spur tip against the horse's body.

Moreover, many boots and chaps are held in place on the wearer's leg or foot by a vertical zipper which extends from the top to the bottom of the boot or chap. This arrangement results in yet another inconvenience from using an instep strap i.e. the necessity of having to completely remove the spur assembly before removing the rider's boot or chap. Furthermore, even if the instep strap were to be removed, the yoke of the spur assembly would still be obstructing access to the vertical zipper, making it impossible to remove the boot or chap with the spur still attached.

One could modify the narrow yoke of an existing spur yoke by removing a section of the arm, to create a half spur. Because the yoke is narrow, it would be necessary to leave a length of yoke on both sides of the spur neck, so the yoke would stabilize somewhat around the back curve of the boot. However, the remaining portion of the yoke may easily poke into the horse as it is a free unsecured end. Furthermore, this remaining section of yoke would obstruct access to the zipper, making it impossible to remove the boot or chap with the spur still attached. To remedy these issues, one could remove the remaining section of yoke to free up access to the zipper. However, this would cause the remaining arm to become even more unstable as it is narrow and able to twist and move up and down on the side of the boot, rendering itself a very unreliable tool for the rider to communicate accurately and consistently with their horse.

Thus, there is a need for a new convenient, easy, improved method of securely attaching a half riding spur to a boot or chap without using an instep strap or obstructing the zipper access, and maintaining lateral stability of the spur to assure accurate and consistent communication with the horse, and whereby the boot or chap can be removed or replaced easily and conveniently with the spur still attached.

SUMMARY OF THE INVENTION

The invention satisfies the need for an improved method of securely attaching a half riding spur to footwear without using an instep strap, wherein the vertical position of the spur tip can be quickly and easily changed, and without having to remove the spur in order to remove the footwear. Additionally, the spur can be quickly and easily attached, adjusted or removed by a rider without having to dismount the horse. Elimination of a tightened instep strap also provides more comfort to the rider.

In an aspect of the invention, a rounded free end of the spur yoke is inserted into a rearward-facing pocket, located on the left or right side of a riding boot or chap, wherein the pocket firmly holds and secures the free end of the yoke in place. An optional design provides two or more pockets on one or both sides of the boot or chap, arranged vertically at different heights, such that a free end of the yoke can be inserted into either an upper or lower pocket in order to achieve a proper fit. The distal end of the arm is rounded in shape so it can pivot smoothly inside the pocket, without interference of corners, when the proximal end, the spur neck and tip, are being adjusted.

Many riding boots and chaps include a full-length vertical zipper, requiring the user to disconnect the instep strap and remove the spur assembly from the footwear before being able to remove their footwear. In another aspect of the invention, by providing only one side pocket, another convenient advantage can be realized: the boot or chap can be removed from the wearer without having to remove the spur, which is accomplished by using a spur yoke wherein one of the free ends is removed, whereby it is not inserted into a pocket. In this arrangement, the removed free end does not cover the vertical zipper, allowing the zipper to be accessed and completely unzipped so that the footwear can be removed.

Instead of a pocket, a releasable fastener such as a snap may be used to secure a free end of the yoke to the left &/or right side of a boot. The snap may also include a strap that can be woven through an aperture at the free end of the yoke.

The spur neck is connected to the proximal end of the arm, and held in place by a vertically positioned strap called a backstrap, which is centrally located on the lower back area of the boot or chap. The lower end of the backstrap is attached to the boot or chap just above the heel where it may be permanently fixed or releasably connected via a fastener such as a snap. The backstrap includes one or more apertures through which the spur neck and spur tip projects. The upper end of the backstrap is connected to the footwear using a releasable fastener such as a snap, which effectively secures the spur neck to the boot or chap in a desired position. By providing multiple apertures in the backstrap, the vertical position of a spur tip can be easily changed by using a different aperture. Furthermore, two or more apertures may be connected to each other by one or more slits, allowing a different aperture to be accessed and used by simply pushing the spur neck up or down along a slit to engage a different aperture. The position of the spur tip can also be changed by unsnapping the upper end of the backstrap, then inserting the spur neck through a different aperture. Another function of having slits between apertures is to allow bulbous spur tips to be forced through a slit in order for the spur neck to engage a desired aperture. In some instances, two or more backstraps may be used to secure a spur in various positions.

In another aspect of the invention, the yoke is wide and relatively flat in structure, when compared with a traditional spur configuration. The extended width of the invention provides significantly more surface contact with the boot, whereby it is unable to twist side to side or move freely up and down. Furthermore, the present invention features a camber, or twist, starting about half way up the arm extending to the distal end of the arm, angling inwards slightly, blending from 0 degrees at the start, and finishing at approximately 6-8 degrees of twist at the distal end of the arm. Thus, taking closer resemblance to the anatomical shape of the boot. The advantage of this is that the half spur arm sits very snuggly in contact with the boot, whereby its position and attachment to the boot are tight and reliable for the user, ensuring a consistent spur tip position for clear communication with the horse.

In another aspect of the invention, two large apertures are necessary to incorporate in the structure with the primary purpose of reducing weight, and also to provide an aperture, at the distal end, by which to hang the half spurs for storage. An elongated aperture along the side of the arm is connected in the center with a tie, to reinforce structure, and to provide a point where the camber begins.

These and other features, advantages and objects of the present invention will be further understood and appreciated by those skilled in the art by reference to the following specification, claims and appended drawings.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
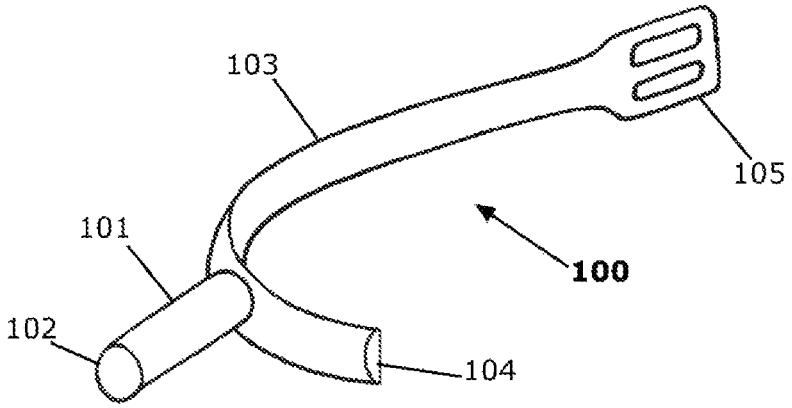
FIG. 1 is a perspective view of a modified half spur yoke having only one fastenable free end according to the preferred embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an equestrian half spur with adjustable spur holder. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 illustrates a half-spur 100 with a spur neck 101 and spur tip 102. A yoke 103 includes a fastenable free end 105 and a shorter, non-fastenable free end 104. Those skilled in the art will recognize that the yoke 103 as used in the half-spur 100 is shown as a portion of a traditional full yoke.

Figure 2A:
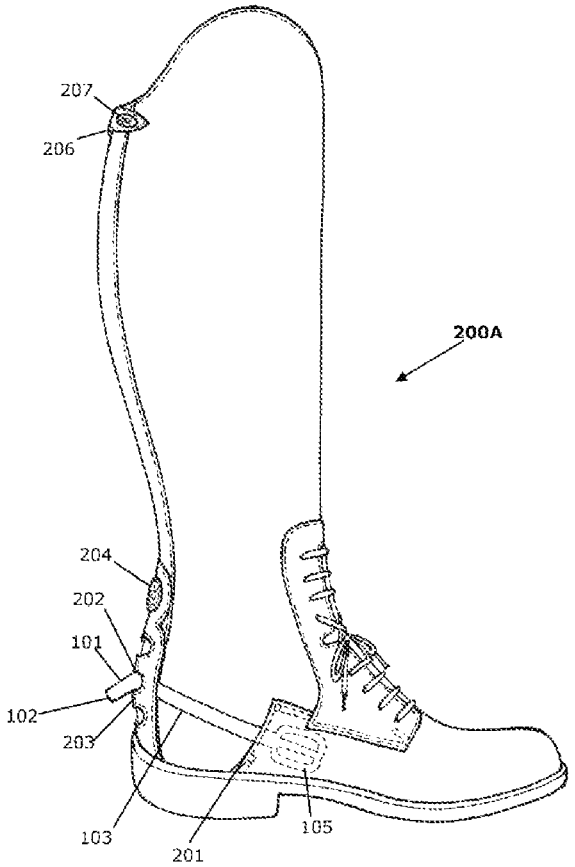
FIG. 2A is a side view of a boot fitted with the modified spur yoke of FIG. 1.
Figure 2B:
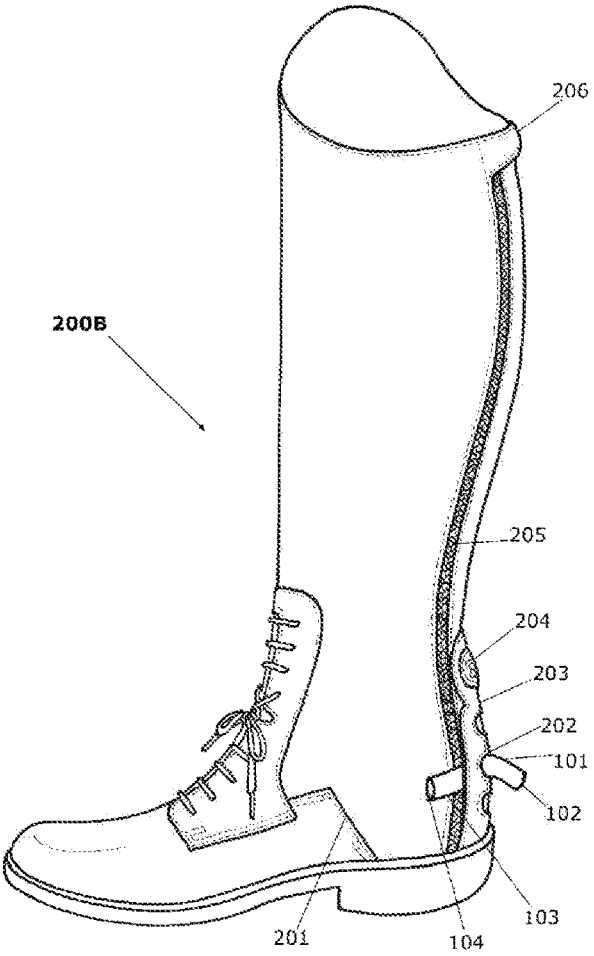
FIG. 2B is an opposite side view of the boot shown in FIG. 2A.

FIG. 2A and FIG. 2B illustrate a side views of the improved riding boot. Although shown here as a boot, those skilled in the art will further recognize that the invention may be used in connection with boots, chaps and other types of equestrian footwear. As seen with regard to both FIG. 2A and FIG. 2B, the boot 200A/200B includes a back strap 203 with an aperture 202 and a pocket opening 201 is shown for securely holding the half-spur. The top end of the full-length zipper 205 is covered by a flap 206 which is fastened by a snap 207. In this embodiment, the yoke 103 is used, with the shorter free end 104 of yoke 103 which is positioned obstructing the zipper 205. The purpose of the half-spur is to enable the boot 200 to be removed from a rider's leg without having to remove the yoke 103. Further, a backstrap 203 includes a snap 204 and aperture 202, which supports and secures the spur neck 101 and spur tip 102. As seen in FIG. 2B, the back strap 203 is used with an interior pocket having an opening 201 into which the longer free end 105 of yoke 103 is inserted. The spur neck 101 and spur tip 102 project through aperture 202 and are secured to the boot 200B by backstrap 203 and snap 204 allowing the half-spur to be securely held into position.

Figure 3:
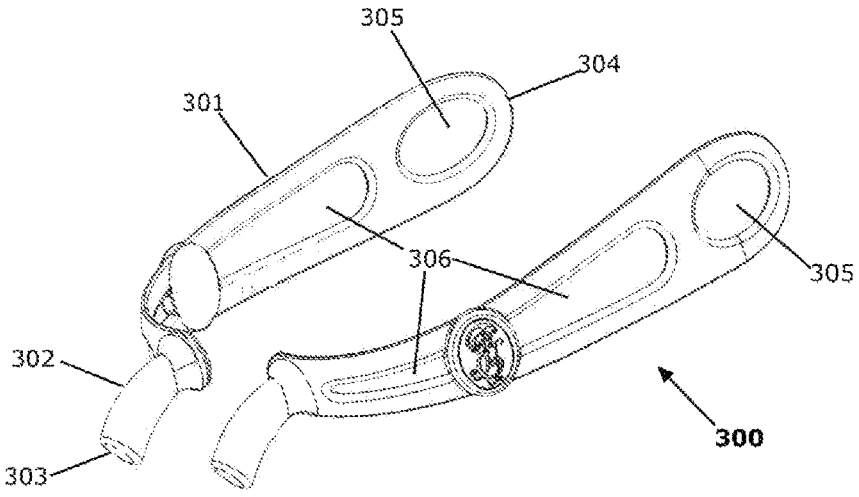
FIG. 3 illustrates a pair of half spurs according to an alternative embodiment of the invention.

FIG. 3 illustrates a pair of half-spurs according to another embodiment of the invention. The half-spur on the left is used with the rider's left boot or chap while the half-spur on the right is used with the rider's right boot or chap. The description as set forth herein, applies to both the left and right half-spur as the only difference is the direction of the curve or arm.

A half-spur 300 includes a support arm or yoke 301 have a proximal end 303 and distal rounded end 304. The arm includes an inwardly facing bend or curve at is proximal end where the spur neck 302 is mounted. The spur 300 includes a spur neck 302 and a spur tip 303. The spur neck 302 is constantly cylindrical in cross-section and is not straight but instead is configured to extend downwardly from the arm 301 toward the ground when warn by the rider. The spur tip 303 can be one of a variety of shapes and sizes as required and selected by the rider. The distal end 304 is expanded in diameter with a rounded end to facilitate insertion into the pocket of a boot or chap, and assist a smooth pivoting action when the proximal spur tip end is adjusted up or down. As will be described herein the curved arm 301 includes a twist or camber in its body so to better conform to the contour of a riding boot.

Each arm 301 includes one or more apertures. For example, in this embodiment, a first aperture 306 is oblong in shape and works to reduce the overall weight of the half-spur. A second aperture 305 is configured at the distal rounded end 304 of the arm 301, further reducing weight, and allows the half-spur to be easily hung or otherwise stored on a hook, nail or fastener.

Figure 4:
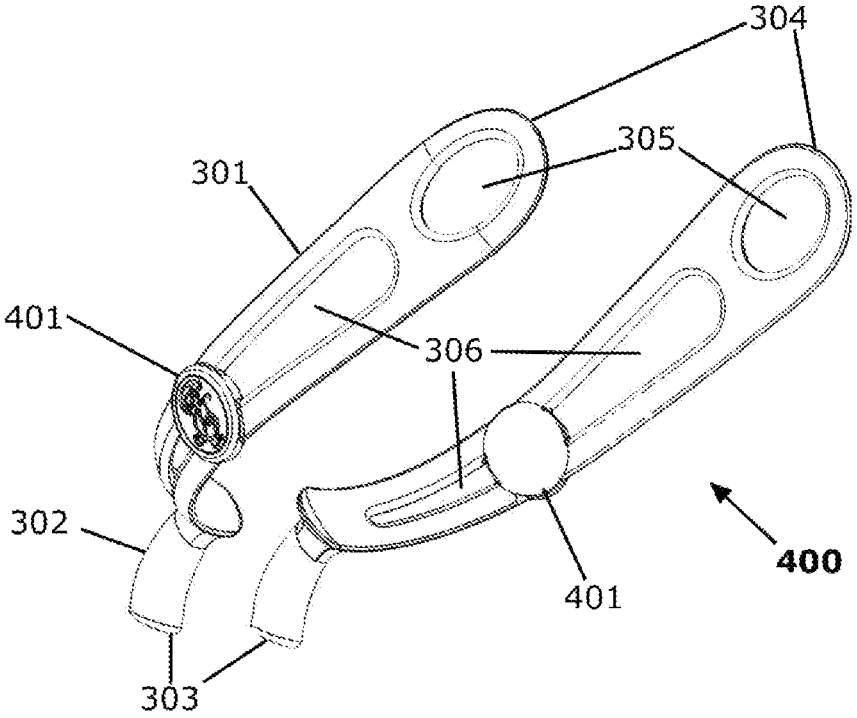
FIG. 4 illustrates the half-spurs has seen in FIG. 3 looking into the inner side of one of the spurs

FIG. 4 illustrates the half-spurs has seen in FIG. 3 looking into the inner side of one of the spurs showing the curve or bend in the arm 301. As described above, each half-spur includes a first aperture 306 that is oblong in shape. The first aperture 306 includes a circular tie 401 positioned approximately half-way across the diameter of the first aperture 306. The circular tie 401 is shown as substantially round in shape and sized to increase the structural integrity of the arm 301.

Figure 5:
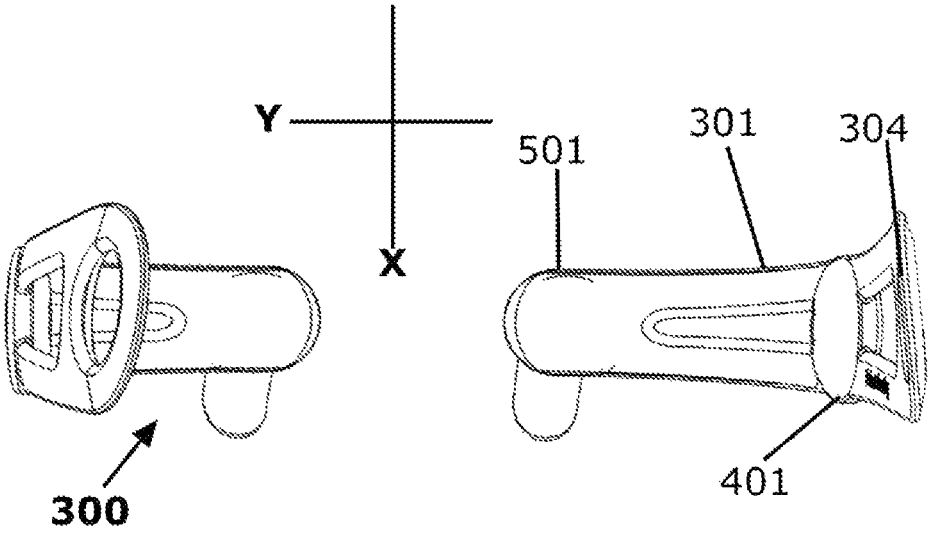
FIG. 5 is a rear view of the half-spurs looking from the distal to proximal end of the arm.

FIG. 5 is a rear view of the half-spurs looking toward the proximal end of the arm. The half-spurs 300 are illustrated where the left spur 501 and its arm 301 include a twist or camber such the distal rounded end 304 of the half-spur face bends in a range of approximately four-degrees to eight-degrees (4°-8°) inwardly as shown on the y-axis from the x-axis. As seen in FIG. 5, the camber begins behind the circular tie 401 allowing the arm 301 to fit firmly against the angled counter of the rider's boot. This configuration holds the half-spur into a fixed position preventing its inadvertent movement by the rider.

Figure 6:
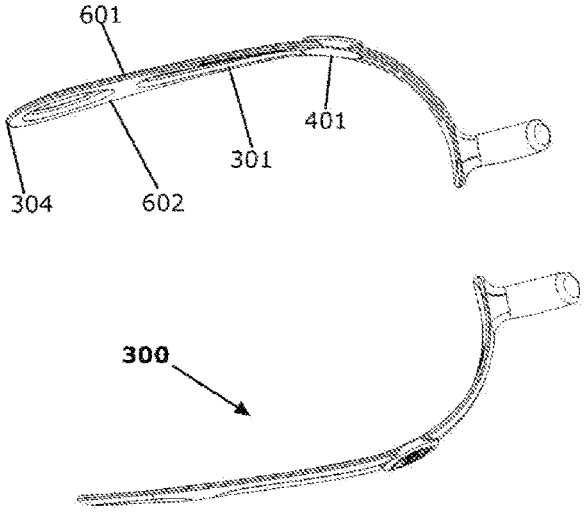
FIG. 6 is a bottom view of the half-spurs looking toward the bottom edge of the arm

Finally, FIG. 6 is a bottom view of the half-spurs looking toward the bottom edge 601 of the arm 301. As seen in FIG. 6, the twist of the arm 301 starting at the tie 401 bends slightly inwardly at a small angle allowing the arm 301 to better fit the overall shape of a riding boot or chap so that it will be firmly held into position when inserted inside the pocket. The top edge 602 of the arm 301 can be seen to angle inwardly at the distal end of the arm 301 when compared with the bottom edge 601 of the arm 301.

Figure 7:
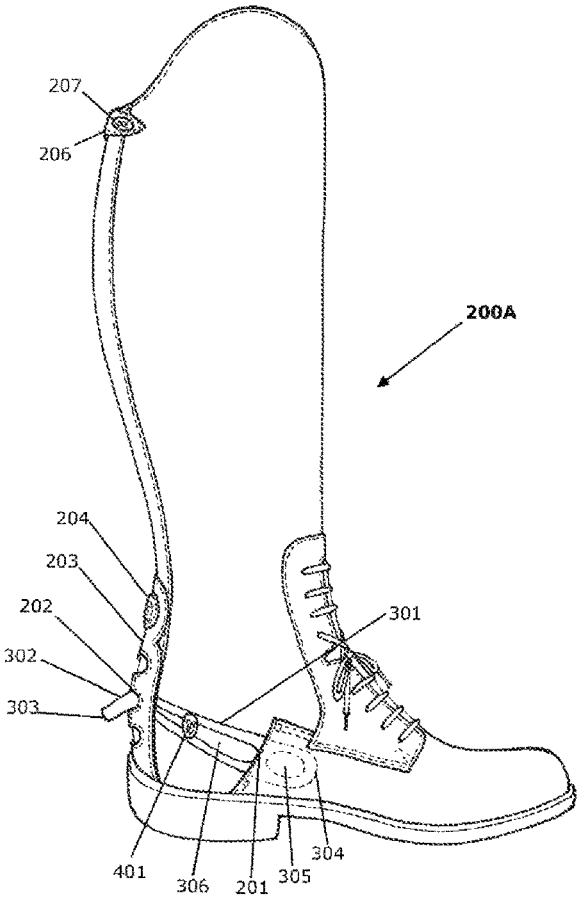
FIG. 7 is an outside view of a boot fitted with the half spur of FIG. 3.
Figure 8:
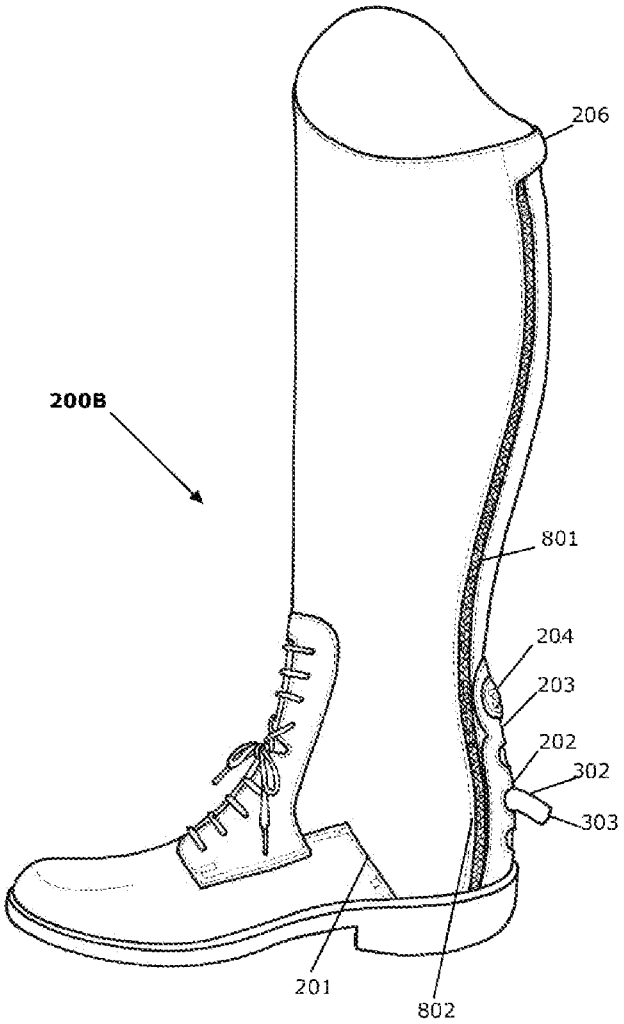
FIG. 8 is an inside view of a boot fitted with the half spur of FIG. 3

FIG. 7 and FIG. 8 illustrate a side views of the improved riding boot. As noted herein, those skilled in the art will further recognize that the invention may be used in connection with boots, chaps and other types of equestrian footwear. As seen with regard to both FIG. 7 and FIG. 8, the boot 200A/200B includes a back strap 203 with an aperture 202 and a pocket opening 201 is shown for securely holding the half-spur. The top end of the full-length zipper 801 is covered by a flap 206 which is fastened by a snap 207. The purpose of the half-spur is to enable the boot 200 to be removed from a rider's leg without having to remove the yoke 301. In this embodiment, the yoke 301 is covering only one side of the boot, whereby not obstructing full access to the zipper 205 in the heel area 802. Further, a backstrap 203 includes a snap 204 and aperture 202, which supports and secures the spur neck 302 and spur tip 303. As seen in FIG. 7, the back strap 203 is used with an interior pocket having an opening 201 into which the longer rounded free end 304 of yoke 301 is inserted. The spur neck 302 and spur tip 303 project through the aperture 202 and are secured to the boot 200 by backstrap 203 and snap 204 allowing the half-spur to be securely held into position. Therefore, FIG. 8 demonstrates that the boot 200B can be removed from the foot, or replaced, without removing the half spur 300.

Thus, the present invention is directed to a half-spur for use with an equestrian boot. The half-spur includes a curved support arm having a cambered twist between a proximal end and a distal end. The spur is attached at the arm's proximal end while the arm's distal end includes a rounded edge for enabling guided entry into a support pocket on the boot, as well as assisting a smooth pivoting action when the proximal spur neck 302 and spur tip 303 are being adjusted upwards or downwards in the back strap apertures. The spur includes spur neck, which bends downwardly toward the ground when warn by the rider, and a spur tip, which can be a variety of shapes and sizes depending on the needs of the rider.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A half-spur for use with equestrian footwear comprising:

a spur having a neck portion and tip portion that extends in a downward direction toward the ground when worn by the user;

a curved body for supporting the spur, where the spur is attached to one end of the curved body and the opposite end of the curved body is configured with a rounded edge; and wherein the curved body extends around only one side of the footwear and is held in position when inserted into a pocket within the footwear.

2. A half-spur as in claim 1, wherein the curved body includes a camber so the curved body approximates the shape of the footwear.

3. A half-spur as in claim 1, wherein the camber is approximately 6-degrees so that the rounded edge extends toward the footwear.

4. A half-spur as in claim 1, wherein the curved body includes at least one elongated aperture cut therein for reducing the weight of the spur.

5. A half-spur as in claim 1, wherein the opposite end of the curved arm includes at least one aperture used for hanging the spur.

6. A half-spur as in claim 1, wherein the spur is substantially round in cross-section.

7. A half-spur as in claim 1, wherein the footwear is a boot.

8. The half-spur as in claim 1, wherein the half-spur remains attached to the boot when boot is removed from a rider's foot.

9. A half-spur for use with an equestrian boot comprising:

a curved arm having an off-center cambered twist between a proximal end and a distal end;

a spur attached at the proximal end of the curved arm; and wherein the distal end of the curved arm has a rounded edge for enabling guided entry into a support pocket on the boot; and wherein a rounded edge of the distal end of the curved arm enables a smooth pivoting action within the pocket on the boot.

10. A half-spur as in claim 9, wherein the spur is comprised of a spur neck and spur tip.

11. A half-spur as in claim 9, wherein the spur is substantially round in cross-section.

12. A half-spur as in claim 9, wherein the cambered twist is approximately between 4 and 8 degrees at the distal end.

13. The half-spur as in claim 9, wherein the curved arm does not obstruct access to a zipper to allow a rider to remove the boot with the spur still attached.

14. A half-spur for use with an equestrian chap or boot comprising:

a curved arm having a camber of approximately 6 degrees for fitting the contour of one side of a boot or chap;

a spur attached at one end of the curved arm; and wherein the opposite end of the curved arm includes a rounded edge for insertion into a pocket formed in the boot or chap.

15. A spur as in claim 14, wherein the curved arm includes at least one elongated aperture for reducing the weight of the spur.

16. A spur as in claim 14, wherein the opposite end of the curved arm includes at least one aperture used for hanging the spur.

17. A half-spur as in claim 14, wherein the spur is comprised of a spur neck and spur tip.

18. A half-spur as in claim 17, wherein the opposite end of the curved arm has a rounded end that pivots smoothly inside the pocket when the spur tip is adjusted.

19. A half-spur as in claim 14, wherein the spur tip extends in a downwardly direction toward the ground when worn by a user.

20. The half-spur as in claim 14, wherein the half-spur remains attached to the boot when the boot is removed from or replaced onto the rider's foot.

* * * * *